US007786713B2

(12) United States Patent
Kimura

(10) Patent No.: US 7,786,713 B2
(45) Date of Patent: Aug. 31, 2010

(54) SERIES REGULATOR CIRCUIT WITH HIGH CURRENT MODE ACTIVATING PARALLEL CHARGING PATH

(75) Inventor: Hiroyuki Kimura, Sendai (JP)

(73) Assignee: Freescale Semiconductor, Inc., Austin, TX (US)

( * ) Notice: Subject to any disclaimer, the term of this patent is extended or adjusted under 35 U.S.C. 154(b) by 524 days.

(21) Appl. No.: 11/854,546

(22) Filed: Sep. 13, 2007

(65) Prior Publication Data

US 2008/0258696 A1 Oct. 23, 2008

(30) Foreign Application Priority Data

Sep. 26, 2006 (JP) ..... 2006-261121

(51) Int. Cl.
*G05F 1/565* (2006.01)

(52) U.S. Cl. ..... 323/269; 323/270; 323/275

(58) Field of Classification Search ..... 323/269, 323/270, 273–281, 224, 226, 268, 293, 298, 323/353

See application file for complete search history.

(56) References Cited

U.S. PATENT DOCUMENTS 6,967,470 B2 * 11/2005 Takabayashi ..... 323/224

FOREIGN PATENT DOCUMENTS

JP 2001117650 A 4/2001
JP 2002312043 A 10/2002
JP 2005190381 A 7/2005

* cited by examiner

*Primary Examiner*—Harry Behm
(74) *Attorney, Agent, or Firm*—Charles Bergere

(57) ABSTRACT

A series regulator circuit for reducing current consumption, enabling switching between different current consumption modes, and suppressing output voltage fluctuations. A constant current source 20, connected to an input voltage line, is connected to a ground voltage line via a resistor element 21 and transistor B1. Gate terminals of transistors M2, M4 are connected between the constant current source 20 and transistor B1. The transistor M2 is connected to the input voltage line via a transistor M1 activated in a high current mode. The source terminals of the transistors M2, M4 function as the series regulator circuit output terminal, which is connected to the ground voltage line via a resistor element 23 and transistor M3, activated in a high current mode, or via resistor elements 24, 25. A connection node between the resistor elements 24, 25 is connected to a base voltage of the transistor B1.

5 Claims, 3 Drawing Sheets

SERIES REGULATOR CIRCUIT WITH HIGH CURRENT MODE ACTIVATING PARALLEL CHARGING PATH

BACKGROUND OF THE INVENTION

The present invention relates to a series regulator for outputting a constant voltage, and more particularly, to a series regulator circuit switchable between different modes such as a low current consumption mode and a high current consumption mode.

A series regulator circuit is known in the prior art as a circuit that outputs constant voltage even when the input voltage changes. There is a type of series regulator circuit that switches modes for different current consumptions in accordance with, for example, whether a device to which the series regulator circuit is applied is in an operational state or a standby state (refer to, for example, Japanese Laid-Open Patent Publication No. 2001-117650 (FIG. 2) and Japanese Laid-Open Patent Publication No. 2002-312043 (FIG. 1)).

Japanese Laid-Open Patent Publication No. 2001-117650 describes a series regulator circuit including a first constant voltage circuit, which consumes a large amount of current but eliminates ripples and has superior load transition response, and a second constant voltage circuit, which has a low ripple elimination rate and low load transition response but consumes a small amount of current. The series regulator circuit generates an output by switching the constant voltage circuits while using the same output transistor.

Japanese Laid-Open Patent Publication No. 2002-312043 describes a series regulator circuit including a reference voltage generation circuit, which generates a reference voltage, a detection circuit, which generates and outputs voltage that is in accordance with a detected output voltage, a first operational amplifier, which consumes a large amount of current but operates at high speeds, and a second operational amplifier, which suppresses current consumption. The first and second operational amplifiers compare the reference voltage with voltage generated by the detection circuit and provides the control terminal of a transistor with an output corresponding to the comparison result so that the output voltage becomes constant.

Glitches (noise) may be generated when switching currents. Accordingly, Japanese Laid-Open Patent Publication No. 2005-190381 (refer to FIG. 1) proposes a series regulator circuit that suppresses the generation of glitches when the current consumption is switched to a different state.

Japanese Laid-Open Patent Publication No. 2005-190381 describes a constant voltage power supply including two types of constant voltage circuits having different transition responses and current consumptions. When the load state is switched, operational amplifiers are operated in each of the two constant voltage circuits. The generation of noise is suppressed when switching the two constant voltage circuits by providing a period during which an intermittent circuit is activated in each of the two constant voltage circuits.

The series regulator circuits of the above patent publications are formed so that two circuits are switched in accordance with two different current consumption states. Thus, each series regulator circuit includes two operational amplifiers. If the same operational amplifier can be used commonly for the two current consumption states, this would further reduce current consumption of the series regulator circuit. However, the use of the same operational amplifier may lower the response speed, generate glitches when switching modes, and cause output voltage fluctuation such that constant voltage cannot be supplied.

SUMMARY OF THE INVENTION

It is an object of the present invention to provide a series regulator circuit that switches between different current consumption modes, lowers the current consumption, and suppresses output voltage fluctuation.

One aspect of the present invention is a series regulator circuit including a first transistor connected to a constant current source, which is connected to an input voltage line, and a reference voltage line. A second transistor is connected to the input voltage line and an output terminal. A first switch element is connected to the input voltage line. A third transistor is connected to the first switch element and the output terminal. A first resistor and a second resistor are connected in series between the output terminal and the reference voltage line. A third resistor is connected to the output terminal. A second switch element is connected to the third resistor and the reference voltage line. The first transistor includes a control terminal connected between the first resistor and the second resistor. The second transistor and the third transistor each include a control terminal connected between the constant current source and the first transistor. When in a high current mode in which current consumption at the output terminal is high, the first switch element is activated to supply current via the third transistor, and the second switch element is activated so that current flows through the third resistor.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A preferred embodiment of the present invention will now be discussed with reference to FIGS. 1 to 4.

Figure 1:
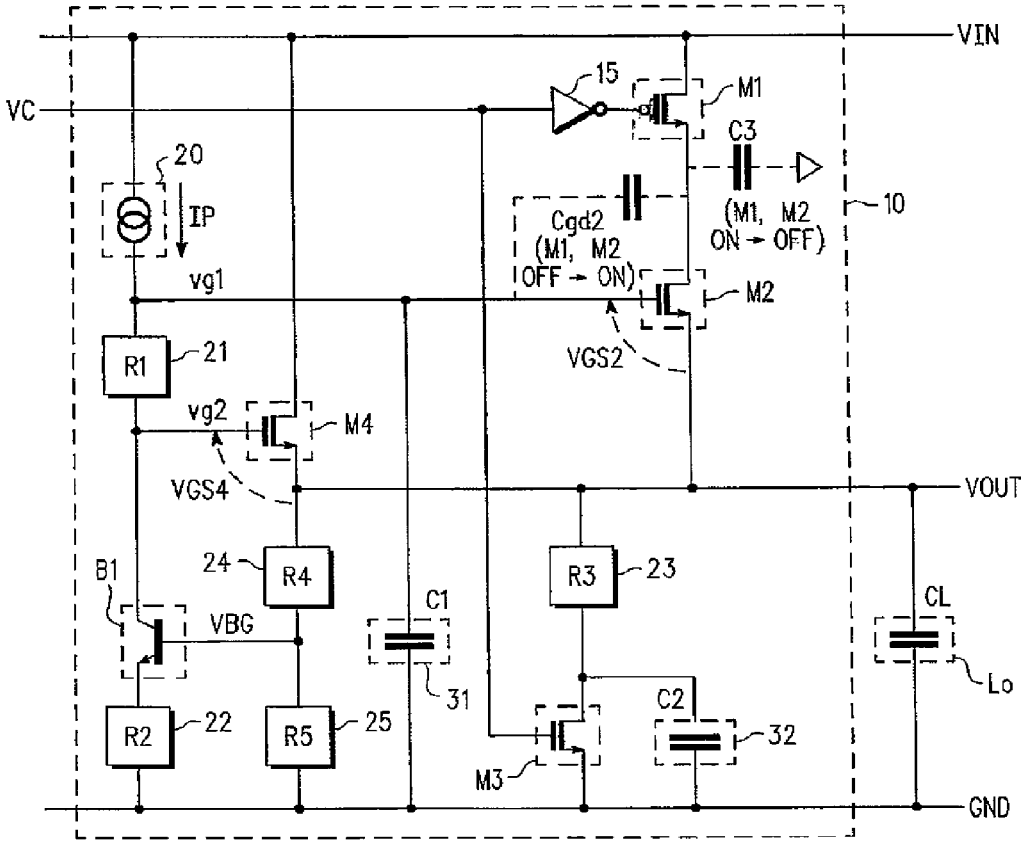
FIG. 1 is a circuit diagram of a series regulator circuit according to a preferred embodiment of the present invention.

Referring to FIG. 1, a series regulator circuit 10 of the preferred embodiment is supplied with input voltage VIN, from which output voltage is generated, and provided with a mode switching signal, which switches current modes. The mode switching signal is for switching between a low current mode and a high current mode.

The series regulator circuit 10 is applied to a device that switches between a standby state and an operational state. The series regulator circuit 10 enters the low current mode when the device is in the standby state and enters the high current mode when the device is in the operational state. In the preferred embodiment, when in the high current mode, the amount of current flowing out of the output terminal of the series regulator circuit 10 is large, and the current consumption varies drastically.

The mode switching signal is provided to an input terminal of an inverter 15. The mode switching signal has voltage VC, which becomes a low level signal voltage for the low current mode and a high level signal voltage for the high current mode.

A constant current source 20 is connected to an input voltage VIN line of the series regulator circuit 10. The constant current source 20 generates a flow of current having value IP. The constant current source 20 is connected to a ground voltage GND line, which functions as a reference voltage line, via a first resistor element 21, which functions as a fourth resistor and which has resistance R1, a bipolar transistor B1, which functions as a first transistor, and a second resistor element 22, which has resistance R2.

Further, a transistor M1, which functions as a first switch element, is connected to the input voltage line VIN. The transistor M1 is a p-channel MOS transistor. The gate terminal of the transistor M1, which is connected to the output terminal of the inverter 15, is provided with an inverted signal of the mode switching signal. Thus, when in the low current mode, the gate terminal of the transistor M1 is provided with a high level signal. This inactivates the transistor M1. When in the high current mode, the gate terminal of the transistor M1 is provided with a low level signal. This activates the transistor M1.

The drain terminal of the transistor M1 is connected to the drain terminal of a transistor M2, which functions as a third transistor. The transistor M2 is an n-channel MOS transistor, which supplies a large amount of current when in the high current mode. More specifically, when the mode switching signal is a low level signal and the transistor M1 is inactivated, a current passage formed by the transistor M1 opens. This inactivates the transistor M2. Further, activation of the transistor M1 increases the voltage at the drain terminal of the transistor M2. This results in the flow of current from the input voltage VIN line via the transistors M1 and M2. In the present embodiment, the ratio of the currents flowing through the transistors M4 and M2 is greater than the ratio of the maximum sizes of the transistors M4 and M2. That is, a device of which gate-source voltage becomes high with a high current is used as the transistor M2. When devices of the same type are used as the transistors M4 and M2, the current density of the transistor M2 increases, and the gate-source voltage VGS2 of the transistor M2 becomes greater than the gate-source voltage VGS4 of the transistor M4. When devices of different types are used as the transistors M4 and M2, the voltages VGS2 and VGS4 are also different.

The gate terminal of the transistor M2 is connected to a connection node between the constant current source 20 and the resistor element 21. The voltage at the gate terminal is represented by "vg1."

The gate terminal of the transistor M2 is connected to 25 the ground voltage GND line via a capacitor 31. The capacitor 31 has capacitance C1 and functions as a first capacitor. Further, the source terminal of the transistor M2 functions as the output terminal of the series regulator circuit 10, and the voltage at the source terminal is the output voltage VOUT.

Further, a transistor M4 functioning as a second transistor is arranged between the input voltage VIN line and the output terminal. The transistor M4 is an n-channel MOS transistor and has a gate terminal connected to a connection node between the resistor element 21 and the collector terminal of the transistor B1. The voltage at the gate terminal is represented by "vg2." The transistor M4 is constantly activated, and current flows from the input voltage line VIN via the transistor M4 to the output terminal.

In the present embodiment, the capacitance C1 of the capacitor 31 and the resistance R1 of the resistor element 21 are set from the input voltage VIN and the output voltage VOUT so as the satisfy equation (1), which is shown below.

$$VGS2\text{on}-VGS4\text{on}=IP\cdot R1+(VIN-VOUT)/(1+C1/Cgd2) \quad (1)$$

In the above equation, "VGS2on" represents the gate-source voltage of the transistor M2 when the transistor M4 is activated and corresponds to "V3" in the claims, and "VGS4on" represents the gate-source voltage of the transistor M4 when the transistor M4 is activated and corresponds to "V2" in the claims. Further, "Cgd2" represents the parasitic capacitance between the gate terminal and the drain terminal and corresponds to "Cp3" in the claims.

The output terminal is connected to the ground voltage GND line via a resistor element 23, which functions as a third resistor and has resistance R3, and a transistor M3, which functions as a second switch element. The transistor M3 is an n-channel MOS transistor and has a gate terminal provided with the mode switching signal. A capacitor 32 is connected to the ground voltage GND line parallel to the transistor M3. The capacitor 32 has capacitance C2 and functions as a second capacitor.

In the present embodiment, the capacitance C2 of the capacitor 32 is set to a value shown in equation (2).

$$C2=C3\cdot(VIN-VOUT)/VOUT \quad (2)$$

In equation (2), "C3" represents the parasitic capacitance at the connection node between the transistors M1 and M2.

Further, the output terminal is connected to the ground voltage GND line via a resistor element 24, which functions as a first resistor and has resistance K4, and a resistor element 25, which functions as a second resistor and has resistance K5. A connection node between the resistor element 24 and the resistor element 25 is connected to the base terminal of the transistor B1.

A load Lo is connected to the output terminal of the series regulator circuit 10. The load Lo has capacitance CL and is connected to the ground voltage GND line.

The operation of the series regulator circuit 10 will now be discussed.

The following equation is derived from the voltage relationship at the transistor B1 of the series regulator circuit 10.

$$IP\cdot R2+VBE=VBG$$

Further, the output voltage VOUT is represented as shown below.

$$VOUT=VBG\cdot(R4+R5)/R5$$

Thus, as long as the base voltage VBG is constant, the output voltage VOUT is constant. The base-emitter voltage of the transistor B1 is temperature-dependent. However, the constant current source 20 supplies current that offsets the temperature dependency. Thus, the temperature dependency of the constant current source 20 compensates for the temperature dependency of the base voltage VBG, which thereby becomes constant. As a result, the output voltage VOUT is maintained at a constant value.

[Low Current Mode]

In the low current mode, a low level signal voltage is provided as the voltage VC. In this case, the gate terminal of the transistor M1 connected to the output terminal of the inverter 15 is provided with a high level signal. Thus, the transistor M1 is inactivated. This stops the flow of current to the transistor M2 from the input voltage VIN line, and the transistor M2 remains inactivated.

Furthermore, the gate terminal of the transistor M3 is provided with a low level signal. Thus, the transistor M3 is inactivated. As a result, current does not flow from the output terminal to the resistor element 23 via the transistor M3.

Accordingly, in the low current mode, when the output voltage VOUT at the output terminal varies and decreases, the divisional voltage of the resistor elements 24 and 25 decreases the base voltage VBG. Further, the collector current of the transistor B1 decreases relative to the current of the constant current source 20. This increases the voltage vg2 which, in turn, increases the gate-source voltage VGS4 of the transistor M4. The amplification effect (effect of voltage-current conversion) of the transistor M4 increases the output current (drain current). Accordingly, a large amount of current flows from the input voltage VIN line via the transistor M4. Such feedback increases the output voltage VOUT.

When the output voltage VOUT varies and increases, the voltage vg2 at the gate terminal of the transistor M4 decreases. This decreases the output current (drain current) and lowers the output voltage VOUT. Thus, when the output voltage VOUT varies, the feedback performed with the resistor elements 24 and 25, the transistor B1, and the transistor M4 keeps the output voltage VOUT substantially constant.

[High Current Mode]

In the high current mode, a high level signal voltage is provided as the voltage VC. In this case, a low level voltage is applied to the gate terminal of the transistor M1 via the inverter 15. This activates the transistor M1. As a result, current flows from the input voltage VIN line to the output terminal via the transistors M1 and M2.

Furthermore, the gate terminal of the transistor M3 is supplied with a high level voltage VC. Thus, the transistor M3 is activated. As a result, current flows from the output terminal to the ground voltage GND line via the resistor element 23 and the transistor M3.

In this case, when the output voltage. VOUT varies and decreases, the base voltage VBG decreases, and the amount of collector current of the transistor B1 decreases. This increases the voltages vg1 and vg2. The increase in the voltage vg2 increases the gate-source voltage VGS4 of the transistor M4. The increase in the voltage vg1 increases the gate-source voltage VGS2. Accordingly, a large amount of current flows from the input voltage VIN line via the transistors M2 and M4. Such feedback returns the output voltage VOUT to its original value.

When the output voltage VOUT varies and increases, the voltages vg1 and vg2 decrease. This decreases the gate-source voltages VGS2 and VGS4 of the transistors M2 and M4 and lowers the output voltage VOUT. Thus, when the output voltage VOUT varies, the feedback performed with the resistor elements 24 and 25, the transistor B1, and the transistor M4 and the feedback performed with the resistor elements 24 and 25, the transistor B1, and the transistor M2 keep the output voltage VOUT substantially constant.

Figure 2A:
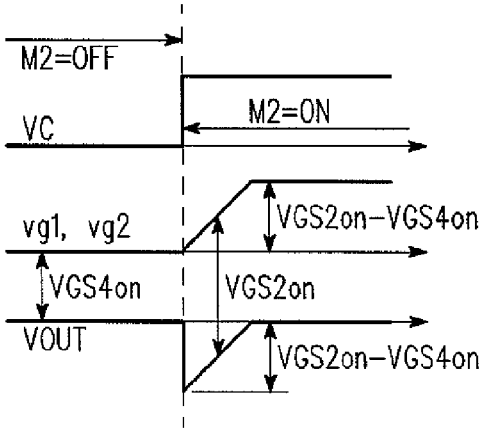
FIG. 2A is a chart showing voltage variation when a fourth resistor is not used.
Figure 2B:
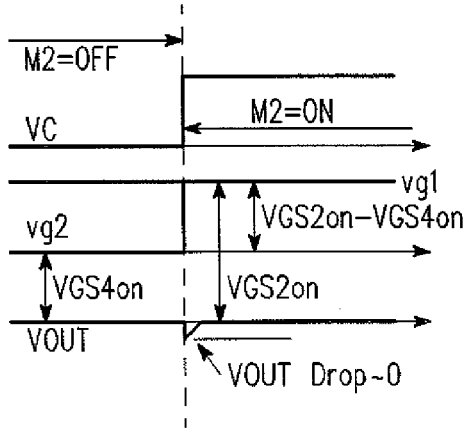
FIG. 2B is a chart showing voltage variation when the fourth resistor is used.
Figure 3A:
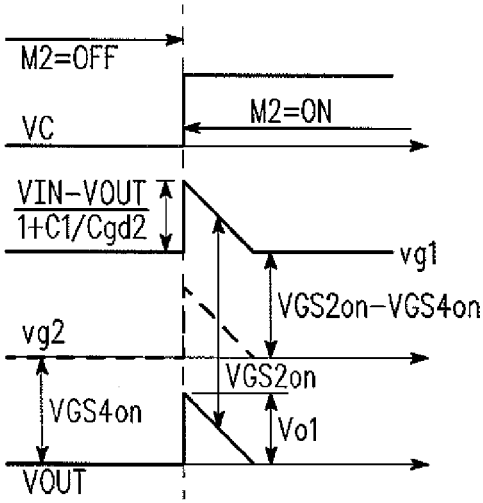
FIG. 3A is a chart showing the relationship between a first capacitor and a constant current source when the voltage difference between the gate terminals of second and third transistors is equal to the voltage drop of the fourth resistor.

Referring to FIGS. 2 to 4, the structures and operations of the resistor element 21 and the capacitors 31 and 32 in the series regulator circuit 10 of the present invention will now be described in detail.

[Resistor Element 21]

FIGS. 2A and 2B show the output voltage VOUT and the time dependency (transition response) of the voltages vg1 and vg2 when the transistor M2 is activated by shifting the voltage VC from the low level to the high level. FIG. 2A shows the transition response when the resistor element 21 of resistance R1 is not used (R1=0). Since the resistor element 21 is not used, the voltage vg1 and the voltage vg2 are equal.

In the low current mode, the transistor M2 is inactivated and the transistor M4 is activated. Thus, the voltages vg1 and vg2 are higher than the voltage at the drain terminal of the transistor M4, which is equal to the output voltage VOUT, by an amount corresponding to the voltage VGS4on.

When switching from the low current mode to the high current mode (when the voltage VC of the mode switching signal shifts from a low level voltage to a high level voltage), the transistor M1 is activated. This activates the transistor M2.

The gate-source voltage VGS2on of the transistor M2 is greater than the gate-source voltage VGS4on of the transistor M4. Thus, activation of the transistor M2 causes the voltage at the drain terminal of the transistor M2, which is equal to the output voltage VOUT, to become lower than the gate terminal voltages vg1 and vg2 by an amount corresponding to the voltage VGS2on.

The voltages vg1 and vg2 are delayed from changes in the output voltage VOUT. Thus, even if the transistor M2 is switched, the voltages vg1 and vg2 do not suddenly increase, and the output voltage VOUT decreases while maintaining the voltage VGS2on. As the voltages vg1 and vg2 increase, the output voltage VOUT increases and takes a constant value again. When the transistor M2 is inactivated, the output voltage VOUT is lower than the voltages vg1 and vg2 by an amount corresponding to voltage VGS4on. Thus, when the transistor M2 is activated, the maximum amount by which the output voltage VOUT is lowered is represented by (VGS2on−VGS4on).

FIG. 2B shows the transition response of the output voltage VOUT and the voltages vg1 and vg2 when the resistor element 21 having resistance R1 is arranged between the gate terminal of the transistor M2 and the gate terminal of the transistor M4.

In this case, the voltage drop caused by the resistor element 21 results in the voltage vg2 being lower than the voltage vg1. The current flowing through the resistor element 21 has the current value IP of the constant current source 20. It is assumed here that the resistance R1 equalizes the voltage drop caused by the resistor element (R1·IP) and the voltage (VGS2on−VGS4on). In this case, the voltage vg1 becomes higher than the voltage vg2 by an amount corresponding to the voltage (VGS2on−VGS4on) when parasitic capacitance of the transistor M2 is not taken into consideration. Thus, when the transistor M2 is activated, as shown in FIG. 2B, the voltage at the source terminal of the transistor M2 becomes the same as the voltage at the source terminal of the transistor M4. As a result, the output voltage VOUT does not vary even if the transistor M2 is activated. Accordingly, in comparison to when the resistor element 21 is not used, fluctuations of the output voltage VOUT are suppressed.

When using different types of transistors and even when using the same type of transistor, proper selection of the resistor element 21 enables transistors of any size to be used as the transistors M2 and M4. This increase circuit design freedom. Further, when the current ratio is large between the low current mode and the high current mode, there is a limit to the minimum size of the transistor M4. Thus, when there is no resistor element 21, the transistor M2 must be enlarged beyond a possible level regardless of the required output current. In such a case, effective adjustments are made with the resistor element 21.

[Setting of the Capacitor 31 and Corresponding Adjustment of the Resistance R1 of the Resistor Element 21]

When the transistor M2 is activated, parasitic capacitance Cg2 exists between the drain and gate terminals of the transistor M2 as shown in FIG. 1. To equalize the voltage drop caused by the resistor element 21 with the voltage (VGS2on−VGS4on), the following relationship must be satisfied.

$$R1 \cdot IP = VGS2on VGS4on$$

When the parasitic capacitance Cgd2 exists, activation of the transistor M2 would temporarily increase the voltage vg1 by an amount corresponding to the voltage Vo1 shown below in accordance with the divisional voltage of the parasitic capacitance Cgd2 and the capacitance C1.

$$Vo1 = (VIN - VOUT)/(1 + C1/Cgd2)$$

Accordingly, the output voltage VOUT is also increased by an amount corresponding to the voltage Vo1.

Figure 3B:
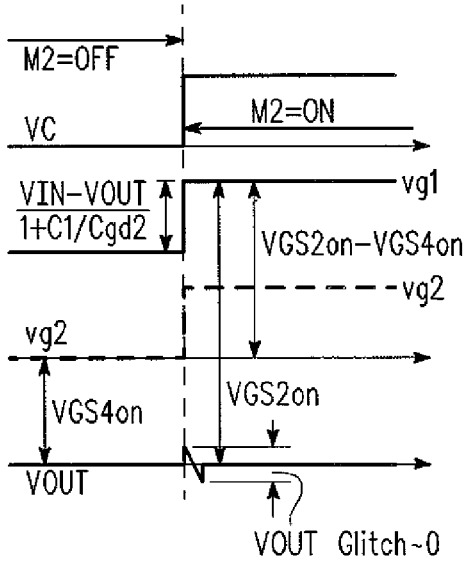
FIG. 3B is a chart showing the relationship between a first capacitor and a constant current source when equation (1) is satisfied.

Therefore, when the transistor M2 is activated, the capacitance C1 of the capacitor C1 is set so that the voltage Vo1, by which the voltage vg1 increases, becomes equal to the voltage vg1 at the gate terminal when the transistor M2 is activated. The resistance R1 of the resistor element 21 is accordingly adjusted. More specifically, the setting is performed to satisfy the above equation (1). As a result, as shown in FIG. 3B, the glitches of the output voltage are substantially null when the transistor M2 is activated.

[Setting of the Capacitor 32]

Referring to FIG. 1, the parasitic capacitance C3 existing at the drain terminals of the transistors M1 and M2 affect operations as described below when the transistors M1 and M2 are inactivated. The parasitic capacitance C3 includes the drain-source parasitic capacitance of the transistor M1, the parasitic capacitance between the drain terminals of the transistors M1 and M2 and the input voltage VIN line or the ground voltage GND line, and the wire capacitance.

Figure 4A:
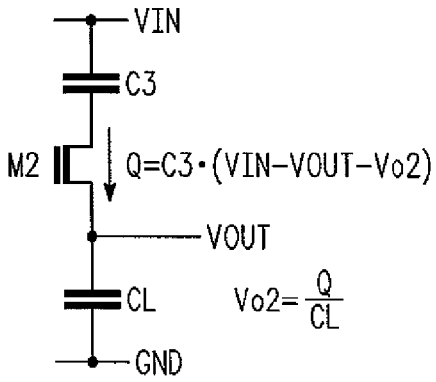
FIG. 4A is a diagram of a circuit that does not include a second capacitor.

FIG. 4A is an equivalent circuit diagram showing the input voltage VIN line to the ground voltage GND line via the transistors M1 and M2, the output terminal, and the load Lo. In the circuit of the diagram shown in FIG. 4A, a capacitor having parasitic capacitance C3 is arranged between the input voltage VIN line and the transistor M2. The transistor M2 is inactivated and thus not shown in the diagram.

Figure 4B:
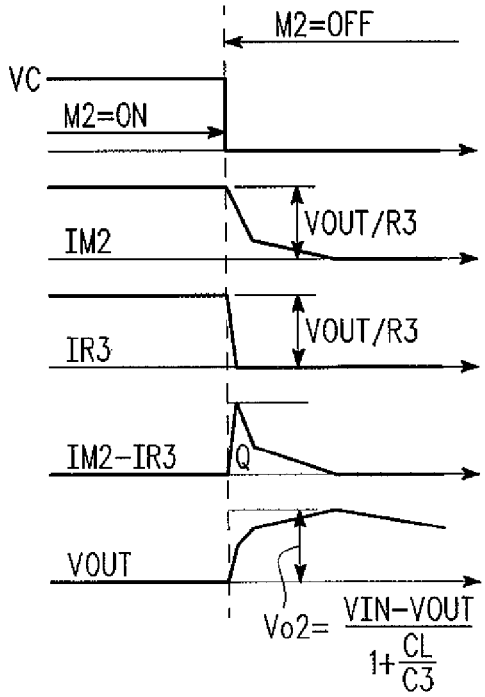
FIG. 4B is a diagram showing variations in the current and output voltage for the circuit of FIG. 4A.

For a state in which the capacitor 32 is not used,

FIG. 4B shows the current IM2 flowing through the transistor M2 when the activated transistor M2 is inactivated, the current IR3 flowing through the resistor element 23, the current variation amount (IM2-IR3) at the output terminal, and the transition response of the output voltage VOUT.

When the transistor M2 of the present embodiment is inactivated, the mode switching signal has a low level.

Thus, the transistor M3 is inactivated. Accordingly, as shown in FIG. 4B, the current (IR3) flowing through the transistor M3 readily decreases to "0" from the current value of the activated state (VOUT/R3).

Since the transistor M2 is inactivated, the current flowing through the transistor M2 also decreases to the ground voltage GND (0) from the current value of the activated state (VOUT/R3). This discharges the parasitic capacitance C3. The discharging causes current to flow through the transistor M2. As a result, as shown in FIG. 4B, the current variation amount (IM2-IR3) causes the flow of excessive current when the transistor M2 is inactivated. In accordance with this current, the output voltage VOUT temporarily increases by an amount corresponding to voltage Vo2, which is described below.

$$Vo2 = (VIN - VOUT)/(1 + CL/C3)$$

The above representation is enabled because the accumulated charge of the parasitic capacitance C3 charges the capacitance CL of the load Lo.

Figure 4C:
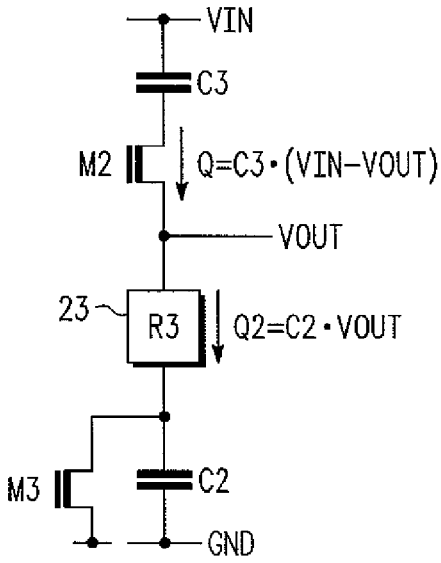
FIG. 4C is a diagram of a circuit that includes the second capacitor.
Figure 4D:
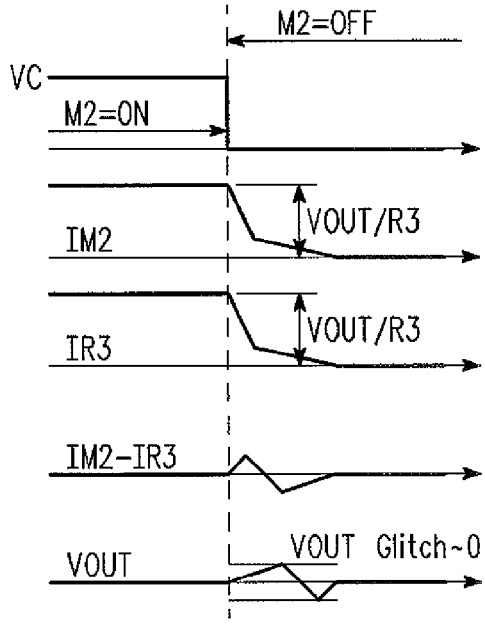
FIG. 4D is a diagram showing variations in the current and output voltage for the circuit of FIG. 4C.

A case in which the capacitor 32 is used will now be described with reference to FIGS. 4C and 4D. FIG. 4C is an equivalent circuit diagram showing the relationship between the parasitic capacitance C3 and the capacitance C2 of the capacitor 32 when using the capacitor 32. In the same manner as in FIG. 4A, FIG. 4C shows a circuit including a capacitor having the parasitic capacitance C3 between the input voltage VIN line and the transistor M2. For a state in which the capacitor 32 is not used, FIG. 4D shows the current IM2 flowing through the transistor M2 when the activated transistor M2 is inactivated, the current IR3 flowing through the resistor element 23, the current variation amount (IM2-IR3) at the output terminal, and the transition response of the output voltage VOUT.

As shown in FIG. 4C, by arranging the capacitor 32 in series with the resistor element 23, the parasitic capacitance C3 charges the capacitor 32. The charge amount flowing through the transistor M2 and the charge amount flowing through the resistor element 23 is as shown below.

$$Q1 = C3 \cdot (VIN - VOUT)$$

$$Q2 = C2 \cdot VOUT$$

To decrease the movement of charges to the output, the movement of the charges must become "0" after a certain period. Thus, charge amount Q1=charge amount Q2 is satisfied, and C3·(VIN−VOUT)=C2·VOUT is satisfied. From this equation, by setting the capacitance C2 of the capacitor 32 to the values shown in the above equation (2), the variation in the current IR3 when the transistor M2 is inactivated is shaped in the same manner as the current variation of the current IM2. Thus, in comparison with the current variation amount (IM2-IR3) in the case of FIG. 4B in which the capacitor 32 is not used, the variation is decreased. Fluctuations in the output voltage VOUT are also decreased and glitches in the output voltage VOUT becomes substantially null. There is a difference between the charge moving speed that appears as the current IR3 and the charge moving speed that appears as the current IM2 at different timings. Thus, current variation that is in accordance with the difference appears in the output. As a result, the output voltage VOUT does not become completely "0" and slightly fluctuates.

The preferred embodiment has the advantages described below.

In the preferred embodiment, the constant current source 20, the resistor elements 22, 24, and 25, and the transistors B1 and M4 are commonly used in the high current mode and the low current mode. In the prior art, to commonly use these elements when switching modes for different current consumptions, the resistances R4 and R5 of the resistor elements 24 and 25 may be increased to decrease the bias current. This would be effective for reducing the current consumption. However, response to changes at the output terminal would become poor. To cope with this problem, a line including the resistor element 23 and the transistor M3 is arranged parallel to the resistor elements 24 and 25 so that current flows through the resistor element 23 in the high current mode. This increases the current for the output voltage VOUT and decreases the current flowing through the resistor elements 24 and 25 in the high current mode. Thus, response to changes in the output voltage VOUT is improved. Accordingly, the number of elements forming the series regulator circuit 10 may be decreased, the current consumption may be reduced, and the response may be improved. This enables the output voltage VOUT to be maintained at a constant value.

In the preferred embodiment, the series-connected transistors M1 and M2 are arranged parallel to the transistor M4, which is arranged between the input voltage VIN line and the output voltage VOUT line. The transistors M1 and M2 are activated when the high level mode switching signal is provided. Thus, in the high current mode, current is supplied to the output voltage VOUT from the input voltage VIN via the transistors M1 and M2 in addition to the transistor M4. This prevents the current consumption from decreasing the output voltage VOUT in the high current mode.

In the preferred embodiment, the resistor element 21 is arranged between the gate terminal of the transistor M4 and the gate terminal of the transistor M2. This enables the voltage vg1 at the gate terminal of the transistor M2 activated in the high current mode to be higher than the voltage vg2 at the gate terminal of the transistor M4, which is constantly activated. Thus, fluctuations of the output voltage VOUT are suppressed when the transistor M4 is activated. Further, proper selection of the resistor element 21 enables transistors of any size to be used as the transistors M2 and M4. This increases design freedom. Additionally, when the current ratio of the low current mode and the high current mode is large, adjustments with the resistor element 21 are effective.

In the preferred embodiment, the capacitor 31 is arranged between the gate terminal of the transistor M2 and the ground voltage GND line. Further, the capacitance C1 of the capacitor 31 is set and the resistance R1 of the resistor element 21 is adjusted so as to satisfy the relationship of equation (1) which is $VGS2on-VGS4on=IP\cdot R1+(VIN-VOUT)/(1+C1/Cgd2)$. This suppresses fluctuations of the output voltage VOUT caused by the parasitic capacitance. Cgd2 when the transistors M1 and M2 are activated. Accordingly, even if the transistors M1 and M2 are activated, the glitches produced in the output voltage VOUT may be reduced.

In the preferred embodiment, the capacitor 32 is arranged parallel to the transistor M3, which is arranged parallel to the transistor M3, between the output terminal and the ground voltage GND line. Further, the capacitance C2 of the capacitor 32 is set to satisfy equation (2), which is $C2=C3\cdot(VIN-VOUT)/VOUT$. This suppresses fluctuations of the output voltage VOUT caused by the parasitic capacitance C3 that exists when inactivating the transistors M1 and M2. Accordingly, even if the transistors M1 and M2 are inactivated, the glitches produced in the output voltage VOUT may be reduced.

In the preferred embodiment, the base-emitter voltage of the transistor B1 is temperature-dependent. However, a current source that supplies current offsetting the temperature dependency is used as the constant current source 20. The temperature dependency of the constant current source 20 corrects the base voltage VBG so that the base voltage VBG becomes constant. As a result, the output voltage VOUT is maintained at a constant value.

It should be apparent to those skilled in the art that the present invention may be embodied in many other specific forms without departing from the spirit or scope of the invention. Particularly, it should be understood that the present invention may be embodied in the following forms.

In the preferred embodiment, the resistor element 21 is arranged between the gate terminals of the transistors M2 and M4. However, the resistor element 21 may be eliminated depending on the relationship of the voltage VGS2on between the gate and source of the transistor M2 and the voltage VGS4on between the gate and source of the transistor M4. This would simplify the structure of the series regulator circuit 10.

In the preferred embodiment, the capacitance C1 of the capacitor 31 is set so that glitches in the output voltage VOUT caused by the parasitic capacitance Cgd2 are substantially null, and the resistance R1 of the resistor element 21 is set accordingly. However, the present invention is not limited in such a manner. As long as equation (1) is satisfied, one of the capacitance C1 of the capacitor 31 and the resistance R1 of the resistor element 21 do not have to be changed and adjusted. Further, the current value IP of the constant current source 20 may be changed and adjusted.

In the preferred embodiment, the capacitors 31 and 32 may be eliminated depending on the level of the parasitic capacitances Cgd2 and C3. This would simplify the structure of the series regulator circuit.

In the preferred embodiment, a single line through which current does not flow in the low current mode but flows in the high current mode is arranged between the output terminal and the ground voltage GND line. Depending on the level of the current consumption in the high current mode, a plurality of such lines may be used.

The present examples and embodiments are to be considered as illustrative and not restrictive, and the invention is not to be limited to the details given herein, but may be modified within the scope and equivalence of the appended claims.

What is claimed is:

1. A series regulator circuit comprising:

a first transistor connected to a constant current source, which is connected to an input voltage line, and a reference voltage line;

a second transistor connected to the input voltage line and an output terminal;

a first switch element connected to the input voltage line;

a third transistor connected to the first switch element and the output terminal;

a first resistor and a second resistor connected in series between the output terminal and the reference voltage line;

a third resistor connected to the output terminal; and a second switch element connected to the third resistor and the reference voltage line;

wherein the first transistor includes a control terminal connected between the first resistor and the second resistor;

the second transistor and the third transistor each include a control terminal connected between the constant current source and the first transistor; and when in a high current mode in which current consumption at the output terminal is high, the first switch element is activated to supply current via the third transistor, and the second switch element is activated so that current flows through the third resistor.

2. The series regulator circuit according to claim 1, wherein:

the first switch element is formed by a p-channel MOS transistor;

the second switch element is formed by an n-channel MOS transistor;

the control terminal of the second switch element is provided with a mode switching signal having a low level when in a low current mode in which current consumption is low at the output terminal and a high level when in the high current mode in which current consumption at the output terminal is high; and the control terminal of the first switch element is provided with an inverted signal of the mode switching signal.

3. The series regulator circuit according to claim 1, further comprising:

a fourth resistor arranged between the constant current source and the first transistor;

wherein the control terminal of the third transistor is connected to a node between the constant current source and the fourth resistor; and the control terminal of the second transistor is connected to a node between the fourth transistor and the first transistor.

4. The series regulator circuit according to claim 3, further comprising:

a first capacitor connected between the control terminal of the third transistor and the reference voltage line;

wherein the second transistor and the third transistor are each formed by an n-channel MOS transistor; and the relationship of $V3-V2=IP\cdot R1\div(VIN-VOUT)/(1+C1/Cp3)$ is satisfied, whereas V3 represents the gate-source voltage when the third transistor is activated, V2 represents the gate-source voltage of the second transistor when the third transistor is activated, IP represents the current value of the constant current source, R1 represents the resistance of the fourth resistor, VIN represents the input voltage, VOUT represents the output voltage at the output terminal, C1 represents the capacitance of the first capacitor, and Cp3 represents the parasitic capacitance between the gate and drain of the third transistor.

5. The series regulator circuit according to claim 1, further comprising:

a second capacitor arranged parallel to the second switch element between the third resistor and the reference voltage line.

* * * * *